United States Patent [19]

Robertson, Jr.

[11] Patent Number: 4,819,819

[45] Date of Patent: Apr. 11, 1989

[54] TAMPER-EVIDENT CLOSURE

[76] Inventor: Bertram D. Robertson, Jr., 1741 Detroit Ave., No. 21, Concord, Calif. 94520

[21] Appl. No.: 173,805

[22] Filed: Mar. 28, 1988

[51] Int. Cl.[4] ..... B65D 51/22

[52] U.S. Cl. ..... 215/230; 215/232; 220/258; 220/270

[58] Field of Search ..... 215/232, 230; 220/258, 220/270; 156/69; 53/412, 420, 478, 487, 489

[56] References Cited

U.S. PATENT DOCUMENTS

| | | | |
|---|---|---|---|
| 4,453,646 | 6/1984 | Harrild | 220/258 |
| 4,606,470 | 8/1986 | Barlics | 215/232 |
| 4,682,702 | 7/1987 | Gach | 215/232 |
| 4,706,837 | 11/1987 | Cooke | 220/270 |

*Primary Examiner*—Donald F. Norton

*Attorney, Agent, or Firm*—William W. Burns

[57] ABSTRACT

A tamper evident closure for a container generally having a cylindrical upstanding neck or throat, the neck having an external thread. The closure comprises an annular element which slides into and mates with the throat of the container, a cylindrical cup which frictionally engages the end of the annular element that extends into the container, the bottom of the cup constituting a flat disc having frangible lines which begin at the outer edge of the disc and wind spirally to the center of the disc ending in a pull tab which extends upwardly in the cup, and a clear cap the internal threads of which mate with the external threads of the neck. The annular element is made of rigid plastic material that is suitable for ultrasonic welding to the throat to create an integrity of the throat and closure.

The cup is made of a softer deformable material such that when the pull tab is pulled to open the closure the unwound portion will be so deformed that it cannot be replaced in its original condition.

10 Claims, 3 Drawing Sheets

FIG_7
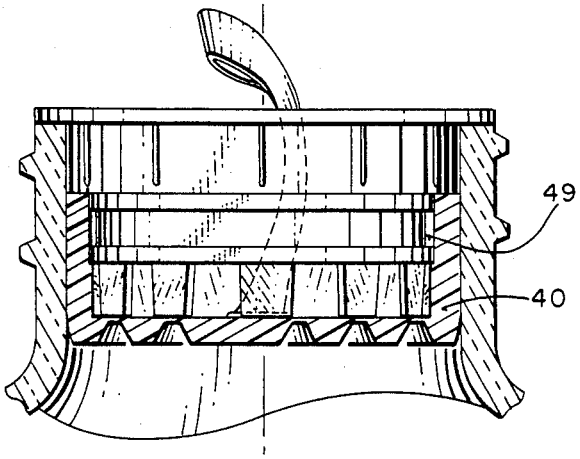
FIG_10
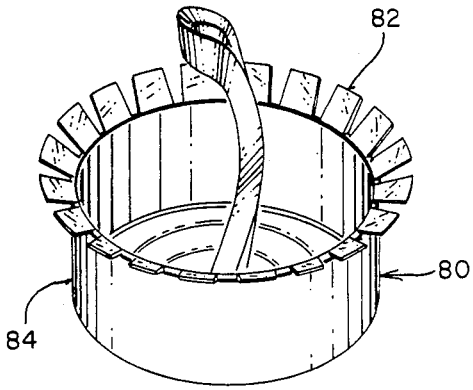
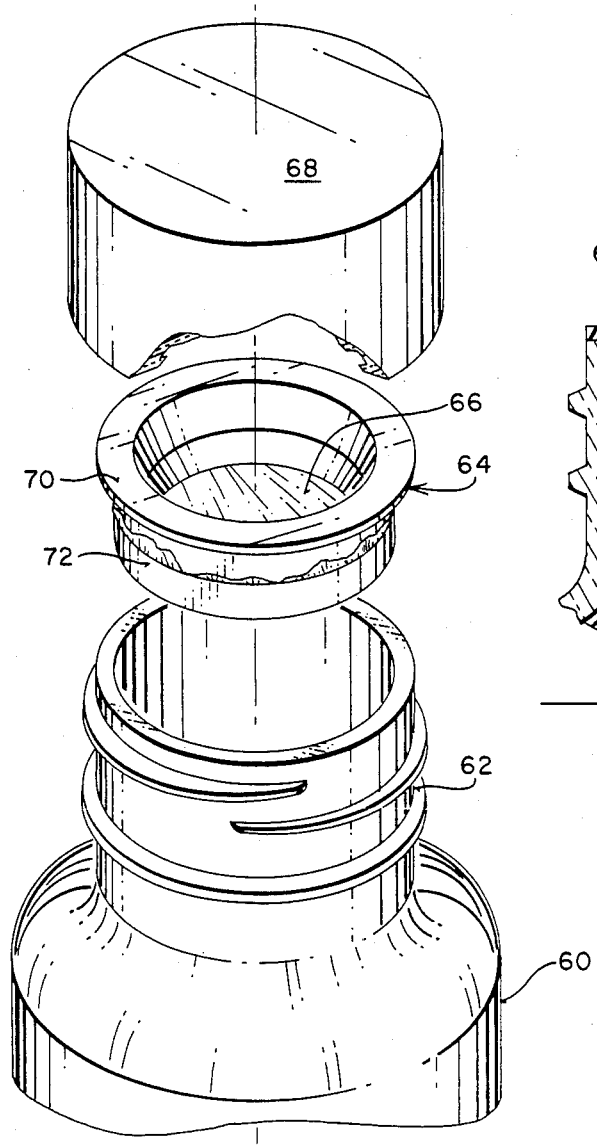
FIG_8
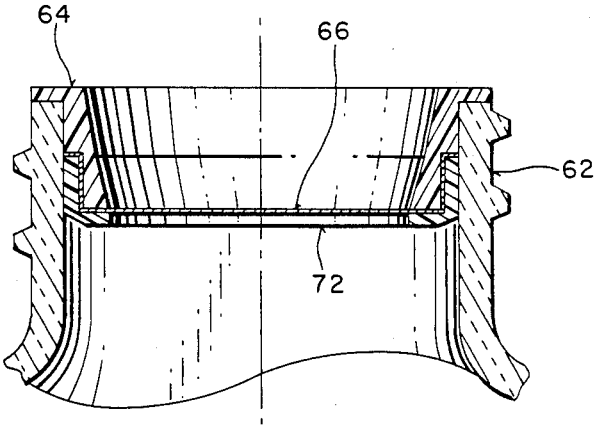
FIG_9

TAMPER-EVIDENT CLOSURE

BACKGROUND OF THE INVENTION

1. Field Of The Invention

This invention relates to a method and apparatus for forming a closure for a container which is both resistant to tampering and which will immediately indicate a violation of the contents.

2. Description Of The Prior Art

The need for tamper resistant or tamper evident seal closures on containers has arisen due to highly publicized incidents of tamperings in which consumers have been killed or injured by contents that have been poisoned. Tamper resistant closures are becoming a necessity for a wide range of containers, especially for those dispensing products intended for internal consumption. Such products include drugs and food products of various types that can be contaminated with toxics or poisons not readily evident to the potential user. While tamper resistant/tamper evident packaging designs have been in the past primarily directed to pharmaceutical and food packaging applications, such designs are now used to protect many other products, such as cosmetics and motor oil from alteration.

A wide variety of such tamper evident seal closures have been suggested in the prior art. Probably the most common is a seal made of foil that is glued across the top lip of the throat of a container. The breaking of such a seal is intended to indicate that the container has been opened and that the security of the container has been breached. However, it has been found that such seals can be removed by the application of heat, and then replaced without an indication of the tampering.

It is important that such tamper evident/tamper resistant seal closures be adapted to provide an indication that the contents of a container have not been tampered with, at least after the contents are initially sealed in the container by the closure means. At the same time it is generally necessary to provide in such a closure means a relatively simple construction, both to further assure reliable operation of the closure and also to make the use of the closure economically feasible.

It is the purpose of the present invention to present a tamper resistant/tamper evident seal closure that is simple in construction while being integrally mated to the container throat and providing immediate evidence to the consumer of tampering with the seal or contents.

SUMMARY OF THE INVENTION

The general purpose of the present invention which will be described subsequently in greater detail is to provide a new and improved method and apparatus for forming a closure for a container of the type having a cylindrical open throat or neck which has all of the advantages of prior art closure means or apparatus and none of the disadvantages. To attain this, the present invention envisions a three part closure in addition to the container, which in the instant invention is also an integral part of the closure. The three parts consist of an annular element or ring, a reverse cap, and a clear outer cap.

The annular ring is designed to mate with the open end of the container and to be integrally bonded to the container by ultrasonic welding or spin welding although other forms of bonding such as gluing are within the purview of this invention. While the internal diameter of the ring is consistent throughout its length, the outside diameter varies in sections, first to create a lip that abuts the rim of the mouth of the container. secondly to present a diameter consistent for mating with the internal diameter of the container, and thirdly to present a section of reduced diameter over which the forward end of the cap is frictionally fitted. Extending from the lower end of this reduced section are teeth or projections which are equally spaced around the periphery thereof.

The reverse cap is made of a material that is similar to rubber in that it is flexible but will provide a tight frictional connection to the annular ring. The closed end or bottom of the cap is scribed with a spiral pattern of frangible lines which begins at the outer periphery of the bottom and ends at the center of the bottom with a pull tab extending upwardly from the bottom. When the tab is pulled a deformed spiral of material unwinds from the center of the bottom.

In the preferred embodiment the cap will be fluorescent orange or green or some other such color that is easily seen through a clear outer cap. Any unwarranted penetration or opening of the bottom of the cap will reveal the white of cotton in contrast to the fluorescent color.

A consumer will immediately be able to determine if the closure or seal has been breached by looking through the clear outer cap. And while the present invention presents a closure that is resistant to tampering and readily shows evidence of tampering it also presents a closure that is relatively easy to open, by simply applying pressure to the pull tab.

There has thus been outlined rather broadly, the more important features of the present invention in order that the detailed description thereof that follows may be better understood, and in order that the present contribution to the art may be better appreciated. There are, of course, additional features of the invention that will be described hereinafter and which will, in addition to the foregoing, form the subject matter of the claims appended hereto. Those skilled in the art will appreciate that the conception, upon which this disclosure is based, may readily be utilized as a basis for designing other structures for carrying out the several purposes of the present invention. It is important, therefore, that the claims be regarded as including such equivalent constructions so far as they do not depart from the spirit of the present invention.

It is therefore an object of the present invention to provide new and improved tamper resistant/tamper evident closures which have all the advantages of prior art closures and none of the disadvantages.

It is another object of the present invention to provide new and improved tamper resistant/tamper evident closures which may be easily and efficiently manufactured and marketed.

It is a further object of the present invention to provide new and improved tamper resistant/tamper evident closures which may be efficiently and reliabily assembled in a rapid manner.

Even yet another object of the present invention is to provide a new and improved temper resistant/tamper evident closure which is susceptible of a low cost of manufacture with regard to both materials and labor, and which accordingly is then susceptible of low prices of sale to the consuming public, thereby making such closures economically available to the buying public.

Even still another object of the present invention is to provide a new and improved tamper resistant/tamper evident closure which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a vertical section displaying an added grove on an annular ring for securing the reverse cap.

FIG. 8 is an exploded perspective view of the second embodiment.

FIG. 9 is a vertical sectional view displaying the annular element of the second embodiment.

FIG. 10 is a view in perspective of a reverse cap displaying bendable projections for centering.

DESCRIPTION OF THE PREFERRED EMBODIMENT

Figure 1:
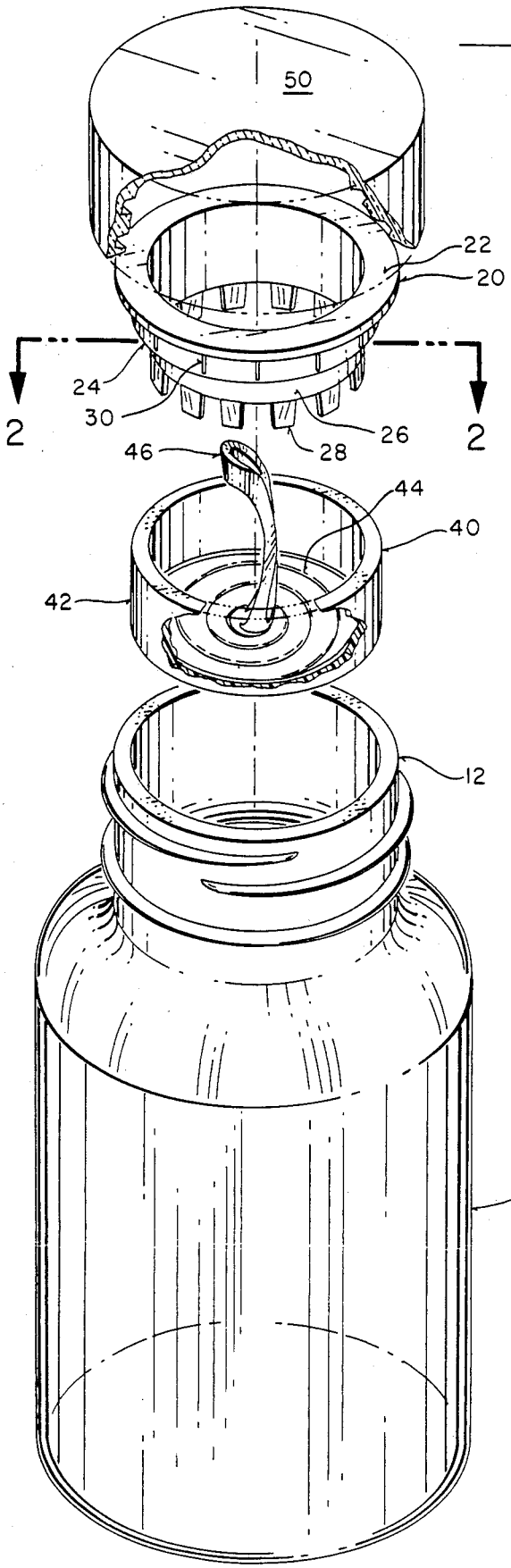
FIG. 1 is an exploded perspective view of the tamper resistant/tamper evident closure including a container.

Referring to FIG. 1 the elements of the instant invention are disclosed in exploded view. The instant invention in its preferred embodiment presents a new and improved method and apparatus for providing a tamper resistant/ tamper evident closure for a container of the type generally indicated at 10 and having a cylindrical open neck or throat 12 with external threads thereon.

The closure means of the preferred embodiment is comprised of three elements or parts in addition to the container 10 which is an integral part of the closure means. The three parts include an annular element or ring 20, a reverse cap 40, and a clear outer cap 50.

The annular element or ring 20 is designed to mate with the open end or throat 12 of the container and to be integrally bonded to the throat 12 by ultrasonic welding or spinwelding or gluing. While the internal diameter of the element 20 is consistent throughout its length, the external diameter varies in sections, first to create a lip 22 the underside of which abuts the rim of the mouth or throat 12 of the container when the element 20 is installed therein, second to present section 24 having a diameter that is slightly less than that of the throat 12 which will allow a secure fit of the closure means in the throat 12, and third to present a section 26 of reduced diameter over which the forward end of the reversed cap 40 will frictionally fit. In addition, at equally spaced intervals about the periphery of the lower end of the annular element 20 axtend trapezoid shaped projections or teeth 28. The faces of the teeth 28 slant inwardly from their upper ends such that the terminus of each tooth is narrower than its beginning.

The element 20 is constructed in the preferred embodiment of a rigid plastic, the same material of which the container 10 is constructed such as polystyene. The element will also include shear directors 30 which are melted by frictional heat in the ultrasonic welding process to form a bond. In FIG. 1, the shear directors are shown equally spaced around the section 24. However, it is also envisioned in the preferred embodiment to alternatively place shear directors on the underside of the lip 22 to create a bond between the underside of the lip 22 and the rim of the throat 12.

Figure 2:
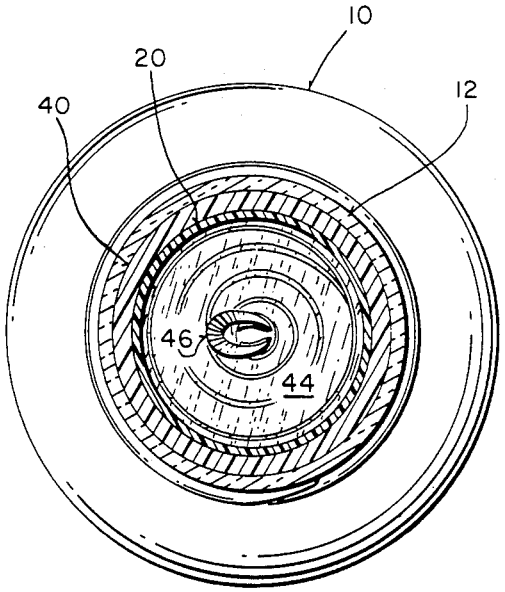
FIG. 2 is a top sectional view of the annular element or ring and reverse cap including the seal.
Figure 5:
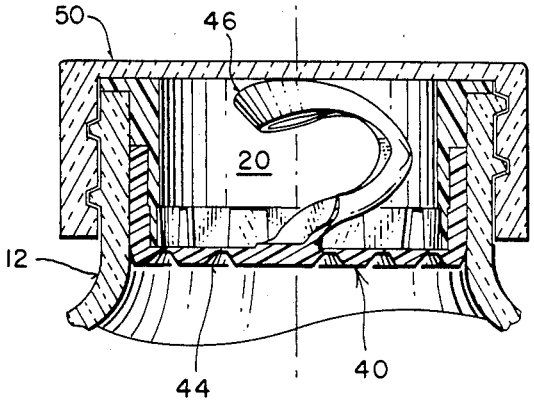
FIG. 5 is a vertical sectional view of the closure of FIG. 3 with the outer cap in place.
Figure 4:
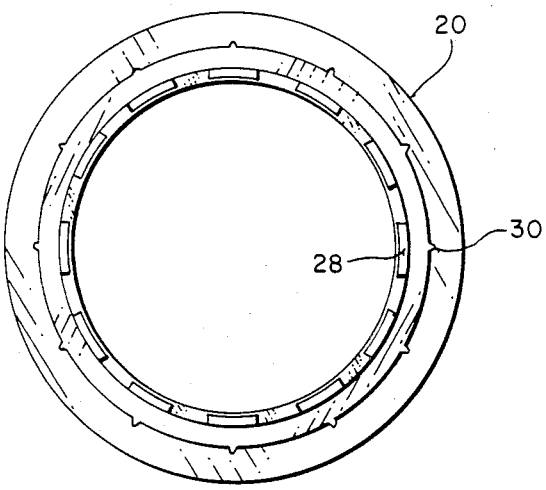
FIG. 4 is a bottom plan view of the annular element.
Figure 6:
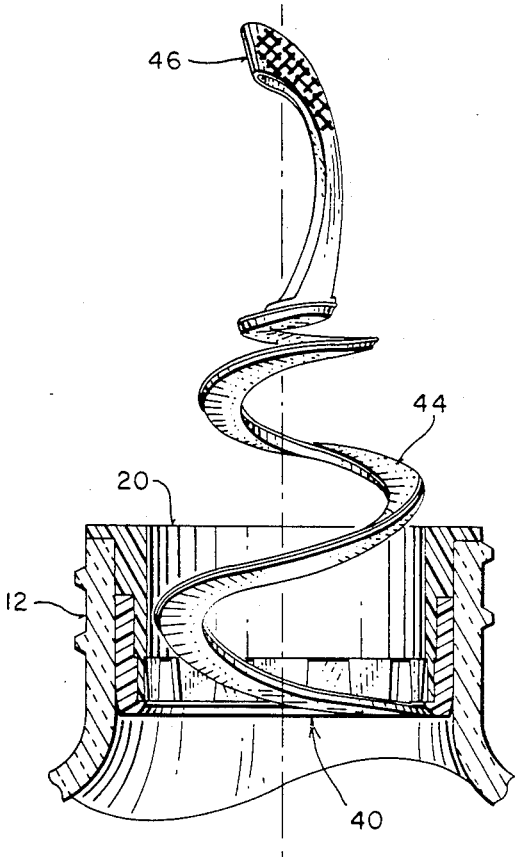
FIG. 6 is a vertical sectional view of the container throat disploying the spirally unwound seal.

The reverse cap or inverted cap 40 consists of a cylindrical portion 42 having an internal diameter only slightly larger than that of the section 26, such that the cap 40 will form a tight frictional fit when installed over the section 26. The external diameter of the portion 42 is slightly less than the external diameter of the section 26 so that it does not interfere with the process of welding of the element 20 to the throat 12. The closed end or bottom 44 of the cap 40 constitutes the seal means of the closure. The bottom 44 is scribed with a spiral pattern (FIG. 2) of frangible lines which begin at the outer periphery of the bottom and end in a point at the center of the bottom with a pull tab 46 extending upwardly from the bottom. The pull tab 46 is constructed with two legs, one at the point of the center of the spiral, and the second spaced a short distance on the spiral from the first leg. The pull tab 46 is flexible allowing it to be bent (FIG. 5) with the outer cap in place.

The cap 40 is made of soft pliable plastic, having the consistency of rubber which is permanently deformable. If the tab 46 is pulled and the spiral is unwound from the middle of the bottom, it will stretch and not be capable of being repaired to its original condition.

In the preferred embodiment the cap 40 will be fluorescent orange or green or some other color that will create a sharp contrast with the cotton or other material inside the neck of a container. The outer cap 50 is constructed of a rigid transparent plastic to allow a clear view of the bottom of the cap 40.

Figure 3:
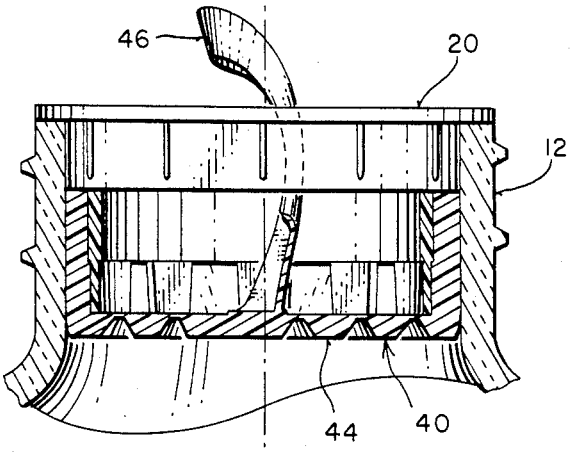
FIG. 3 is a vertical sectional view of the container with the annular ring and reverse cap installed.

Assembly of the container 10 and the closure means begins with the placement of the cap 40 in frictional engagement over the reduced diameter section 26 of the annular element 20. The assembly of the element 20 and the cap 40 is then lowered into secure engagement with the throat 12 of the container 10 which has previously been filled with tablets, capsules, or other contents until the underside of the lip 22 abuts the upper end of the throat 12 (FIG. 3).

The element 20 is then integrally bonded to the throat 12 by ultrasonic welding during which shear directors 30 melt to form the bond.

In use the closure means of the present invention allows the consumer to pick up a container from a store shelf and to immediately determine if the seal has been breached. If the seal or bottom 44 has been broken the consumer would see the white of cotton in strong contrast to the fluorescent green or orange of the cap 40. Thus any tampering is immediately evident to the consumer.

The closure means is also resistant to tampering. Since the closure means is welded into place, it cannot be removed in whole without breaking the container 10. Also if there is an attempt to remove the bottom or seal means 44 by pulling the tab 46, the portion that is unwound will be permanently stretched so that it cannot be replaced in its original condition. Such disarray would be evident to the consumer viewing the seal through the cap 50. And finally the teeth 28 which are in tight contact with the bottom 44 of the cap 40 in the assembled closure means make it impossible for anyone attempting to remove the bottom or seal 44 intact because the teeth 28 make it impossible to cut the edge cleanly. This is an important feature in that prior tamperings have been undectected because the culprits have cleanly removed the seal with a razor blade or X-Acto knife and then replaced the seal without leaving a noticeable trace. The teeth 28 of the present invention will only allow a jagged edge.

The present embodiment relies upon a frictional fit between the cap 40 and the annular element 20. FIG. 7 presents an additional means to hold the cap in place. A groove 49 is added to the circumference of the element 20. With a reverse cap such as 40 the pliable material of the cap crimps into the groove 49 to hold the cap in place.

A second embodiment of the present invention is presented in FIG. 8 in exploded view. This embodiment also presents a closure means that is designed for installation in the cylindrical open throat 62 of the container 60. The closure means of this embodiment is comprised of three parts, an annular element or ring 64, a transparent membrane 66, and a clear outer cap 68.

The annular element 64 has a readially extending lip 70 and a cylindrical section 72. The outer diameter of the section 72 is slightly less than the internal diameter of the throat 62 to allow for a secure fit of the ring 64 into the throat 62. Shear directors are raised on the lower edge of the lip 64 which abuts the rim of the throat 62. The shear directors melt to create the bond between the ring 64 and the throat 62 when ultrasonic welding energy is applied.

The membrane 66 is stretched across the open lower end of the element 64 to create a seal. The membrane is to be bonded to the element 64 or held in place by any suitable means. Once the membrane is in place, the ring 64, including the membrane, is welded or bonded into the throat of the container 60. The clear outer cap 68 is then screwed into place over the throat 62.

In this embodiment it is intended that the membrane will be constructed of a transparent plastic material that can be stretched to form the membrane, but that will shrink if it is cut or breached. It is also intended that the transparent membrane will be colored a fluorescent orange, or green, or a color that will show a marked contrast with the cotton that is normally used in the throats of containers holding pills or tablets.

The instant embodiment will readily display any disturbance of the membrane or seal 66 in that a consumer will be able to immediately see through the cap 68 that a penetration or breach of the membrane 66 has occured. Because of the contrast between the fluorescent color of the membrane 66 and the cotton below, any opening in the membrane will be immediately evident.

The instant embodiment is also resistant to tampering because of the nature of the membrane. If the membrane is cut or pierced it will skrink from the location of the breach. Since the ring 64 is integrally welded to the container, any repairs that are made to the membrane would have to be made with the membrane in place. This would be extremely difficult, if not impossible to do, and any repairs that are made would be evident as crimps or creases.

Referring to FIG. 10 a further embodiment of the reverse cap, which has been described previously herein, is disclosed. The reverse cap 80 of this embodiment includes a series of bendable projections 82 equally spaced about the periphery of the rim of the cylindrical section 84.

In the container industry it is expected that the closure means described herein would be installed into a series of containers having throats that vary slightly in diameter. With the reverse cap 70 installed upon an annular ring of the type 20 the assembly of ring and cap is placed into the throat of a container. As the assembly is pushed into the throat, the projections bend inwardly to form a conical slide which has the effect of centering the assembly. In this instance ultrasonic welding or spin welding would be utilized a previously described to weld the ring to the throat of the container.

What is claimed is:

1. A tamper evident/tamper resistant seal closure for a container, having a generally cylindrical open throat, comprising: an annular element bonded to the throat of the container, the annular element including a consistent internal diameter, and an outer diameter that is varied to form firstly a lip for mating with the rim of the container throat, secondly a section which has an outer diameter only slightly smaller than the internal diameter of the container throat, and thirdly a section of reduced outer diameter; and an inverted cap comprised of an upwardly extending cylindrical portion sized to fit tightly over the third section of the annular element, and a flattened bottom, including frangible seal means therein.

2. The closure of claim 1 wherein the frangible seal means comprises a circular portion of the bottom that is scribed with a spiral pattern that allows the frangible seal means to be broken and pulled out of the container throat in a spiral pattern from the center of the frangible seal means to the outside edge of the seal means.

3. The closure of claim 2 wherein the frangible seal means is constructed of pliable plastic that is permanently stretched and deformed as the frangible seal means is broken so that the frangible seal means cannot be reconstructed after the frangible seal means is broken.

4. The closure of claim 3 wherein a pull tab extends upwardly from the center of the frangible seal means.

5. The closure of claim 1 wherein equally spaced teeth extend from the periphery of the third section of the annular element that extends into the container.

6. The closure of claim 5 wherein the container and the annular element are constructed of a rigid plastic such as polystyrene.

7. The closure of claim 1 wherein the inverted cap is colored with fluorescent or other bright colors to create a sharp contrast between the inverted cap and the container contents when the frangible seal means is broken.

8. The closure of claim 7 wherein a clear outer cap secured to the throat of the container provides a clear view of the frangible seal means.

9. The closure of claim 1 wherein the annular element is permanently bonded to the throat of the container by ultrasonic welding.

10. The closure of claim 1 wherein the annular element is permanently bonded to the throat of the container by spin welding.

* * * * *